United States Patent [19]

Pomero

[11] Patent Number: 5,069,576

[45] Date of Patent: Dec. 3, 1991

[54] ROAD SAFETY BARRIER

[75] Inventor: Claude Pomero, Beziers, France

[73] Assignee: Les Profiles Du Centre, Saint Pourcain Sur Sioule, France

[21] Appl. No.: 464,132

[22] Filed: Jan. 16, 1990

[30] Foreign Application Priority Data

Jan. 17, 1989 [FR] France ..... 89 00580

[51] Int. Cl.[5] ..... E01F 15/00

[52] U.S. Cl. ..... 404/6; 256/13.1

[58] Field of Search ..... 404/6, 7, 9; 256/1, 256/13.1

[56] References Cited

U.S. PATENT DOCUMENTS

| | | | |
|---|---|---|---|
| 2,047,436 | 7/1936 | Shepherd | 256/13.1 |
| 2,228,652 | 1/1941 | Dailey | 256/13.1 |
| 2,536,760 | 1/1951 | Martin | 256/13.1 |
| 2,776,116 | 1/1957 | Brickman | 256/13.1 |
| 3,417,965 | 12/1968 | Gray | 256/13.1 |
| 3,438,611 | 4/1969 | Giavotto et al. | 256/13.1 |
| 4,000,882 | 1/1977 | Penton | 256/13.1 |
| 4,190,376 | 2/1980 | Urlberger | 256/13.1 X |
| 4,460,161 | 4/1984 | Grenga | 256/13.1 |
| 4,723,758 | 2/1988 | Gehrig | 256/13.1 |

FOREIGN PATENT DOCUMENTS

| | | |
|---|---|---|
| 1960908 | 8/1971 | Fed. Rep. of Germany . |
| 2642475 | 4/1977 | Fed. Rep. of Germany . |
| 2252449 | 6/1975 | France . |
| 378358 | 7/1964 | Switzerland . |
| 402922 | 6/1966 | Switzerland . |
| 416713 | 1/1967 | Switzerland . |

*Primary Examiner*—William P. Neuder

*Attorney, Agent, or Firm*—Bell, Seltzer, Park & Gibson

[57] ABSTRACT

A deformable safety barrier placed along a roadside, the barrier being constituted by metal section bars (11) assembled to one another by partial overlapping and by bolting, and supported at intervals by vertical posts, the bar section (11) having a central groove (1) with a rib (2) on either side thereof, the ribs projecting towards the road, each rib also having an outer flange (3*a*) extending away from the road, the barrier being characterized in that the outer flanges (3*a*) of the ribs (2) of the section extend beyond the vertical plane XX' tangential to the bottom of the central groove (1) by a distance lying between one-half and twice the distance between said vertical plane XX' and the points of the ribs (2) closest to the road.

3 Claims, 3 Drawing Sheets

ROAD SAFETY BARRIER

The present invention relates to road safety barriers: it is thus applicable to traffic infrastructure.

More precisely, it relates to a deformable safety barrier placed along a roadside, the barrier being constituted by metal section bars assembled to one another by partial overlapping and by bolting, and supported at intervals by vertical posts, the bar section having a central groove with a rib on either side thereof, the ribs having respective vertex lines lying in the same vertical plane which is parallel to the vertical plane XX' that is tangential to the bottom of the groove, thereby forming a projection towards the road, each rib also having an outer flange extending away from the road and extended by a flange extension beyond the vertical plane XX' which is tangential to the bottom of the central groove.

The invention relates more particularly to a barrier including a conventional metal section bar as standardized by the French Standards Association (AFNOR) and referred to as type A or B.

Safety barriers are installed along the sides of roadways for preventing vehicles leaving a roadway in the event of an incident or an accident. These safety barriers are constituted by metal section bars constituting a vertically-disposed strip with a midline running substantially parallel to the traffic lane of the roadway and they are supported at regular intervals by vertical posts disposed on the opposite side of the barrier to the roadway beside which the barrier is disposed. It is common practice to use such safety barriers along the sides of superhighways, along the entire length of the road, and it is also common practice to use them along the sides of ordinary roads, either at locations where it would be particularly dangerous to leave the road, or else along central regions of roads carrying high traffic density in order to separate the two traffic directions.

It may be observed that a commonly used A or B section has a small moment of inertia about an axis passing through its center of gravity and extending vertically when the bar is bolted to its supports. This moment of inertia is about 100 $cm^4$. The consequences of a small moment of inertia are firstly that the barrier, when subjected to a bending moment due to shock from a vehicle, takes up a radius of curvature which is small since the radius of curvature is proportional to the moment of inertia, and the resulting pocket of deformation is therefore deep, which can give rise to difficulties in extracting the vehicle that gave rise to the deformation from the safety barrier; and secondly authorities in charge of roads desire to limit the distance between obstacles and safety barriers in order to avoid excessive reduction in the width of the roadside shoulder. This concern leads to supports being placed close together in order to limit the depth of such pockets of deformation.

At present, the supports are disposed at intervals of about 4 meters (m), which may be reduced to as little as 2 m where obstacles are very close to barriers: in such cases the barriers may even be reinforced. It can thus be seen that a low moment of inertia for the bar section gives rise to a larger number of supports being used than would be the case if the section had a larger moment of inertia. Unfortunately, the major fraction of the cost of installing safety barriers is constituted by putting the supports into place.

A large number of supports also gives rise to drawbacks concerning the strength of embankments (puncturing), and constitutes a potential danger for motorcyclists sliding on the road surface since they may strike the supports directly.

It is thus both technically and economically advantageous to attempt to reduce the number of such supports, by increasing the moment of inertia about a vertical axis of the section of the barrier.

The technical advantage is that the radius of curvature imparted to the barrier by a given shock is increased, thereby obtaining a better distribution of forces on the supports and better guidance of the out-of-control vehicle.

This reduction in the number of supports also provides technical advantages with respect to the strength of embankments, and greater safety for motorcyclists, as mentioned above.

The economic advantage is that the number of safety barrier supports for equivalent displacements in the event of a shock is reduced, thereby very considerably reducing the cost of supplying and installing safety barriers.

Strength calculations show that it is possible, by increasing the moment of inertia of the section, to place supports every 5 m or 6 m, or thereabouts, instead of every 4 m in a conventional arrangement, or alternatively to continue placing supports every 4 m where a section of smaller inertia would have required the supports to be doubled up.

U.S. Pat. No. 2 776 116 shows a barrier as defined above in which the flanges of the section diverge at 45°, which provides a small moment of inertia. In addition, the flanges tend to splay out considerably in the event of a shock such that the moment of inertia is greatly reduced on impact, i.e. on the very occasion when it is necessary to have a large moment of inertia in order to retain barrier stiffness.

Another prior section bar is shown in German patent application 1 960 908 and is said to have a "modified-A" section. The purpose of the modified-A section is to increase the wall thickness of the bar while retaining substantially the same weight for a bar having the modified section as for a conventional A-section bar to which the subject matter of the present invention refers, as also shown in said published patent application number 1 960 908. In the prior proposal, the wall thickness of the bar can be increased while retaining the same weight as before by reducing the depth of the central groove to about one-half its previous depth while retaining the initial length for the outside flanges of the ribs flanking the groove. This naturally reduces the moment of inertia of the modified section, whereas one of the objects of the present invention is to increase the moment of inertia of the section for given wall thickness, or to reduce the wall thickness of the section for given moment of inertia. In addition, this proposed section is not superposable on an A-section barrier.

Another barrier using a different section bar is described in U.S. Pat. No. 2 228 652. In this case, the prior barrier is not intended to deform under the effect of shock from a vehicle, but, by virtue of a special shape, it is intended to get a hold on the tops of the hubs of the vehicle wheels and to exert a force on the wheels urging them to remain in contact with the road. Given that this barrier is not fixed to its support posts via the bottom of a central groove, but is held by its lateral extremities, and given that its outer flanges extend horizontally rearwards to enable the barrier to be fixed, the bar shears in the event of a severe shock from a vehicle and therefore ceases to act as a barrier.

The object of the present invention is to provide a safety barrier of the type mentioned, in which the moment of inertia of its section is greater than that of the barriers currently in use, and which is capable of being assembled with current barriers without difficulty.

According to the invention, this object is achieved by the fact that the outer flanges of the ribs of the section extend beyond said vertical plane by a distance lying between one-half and twice the distance between said vertical plane and the plane passing through the vertex lines of the ribs.

Preferably, these flange extensions have the same thickness and are made of the same substance as the remainder of the bar.

It is advantageous for the two flange extensions of the section to diverge, thereby enabling bars to be nested for transport and for assembly.

By having these flange extensions which extend the section rearwards away from the road, the moment of inertia of the section about a vertical axis passing through its center of gravity is considerably increased. This moment of inertia is about 100 $cm^4$ for present-day W-section bars having a groove whose depth is about 80 mm, and it is increased by about 10% for 3 cm flange extensions, and it doubles in value for 6 cm flange extensions.

The shape of the bar adjacent to the road is preferably similar to that of one or other of the two varieties of barrier currently in use. This means that such barriers can easily be matched with barriers of the present invention.

A barrier installer can thus install traditional barriers and barriers of the invention in succession, using the same tools and the same methods, and without any additional technical difficulties.

It is advantageous for the flange extensions to extend in a direction which approaches the horizontal, thereby obtaining a maximum amount of increase in the moment of inertia of the barrier about a vertical axis. This may be achieved by making the section follow the arc of a parabola on either side of the central groove. This shape has the additional advantage of providing the best distribution over the structure of forces received at the vertex of the parabola.

It may also be advantageous to fold the end of the flange extension along a fold line parallel to the axis of the road, since such a fold stiffens the bar and reduces the extent to which it is deformed under shock from a vehicle.

Considering a vertical plane passing through the central zone in the form of a groove in a section having a groove with a depth of about 8 cm, the section extends away from the roadway by about 4 cm to about 16 cm relative to said plane, and it preferably extends 6 cm to 8 cm.

The folded margin of the rib extended by a flange extension may come close to being horizontal in shape, e.g. it may be parabolic, going away from the roadway. It may also include a fold of about 2 cm to about 5 cm, thereby kinking the end of the flange extension. The fold may have an angle lying in the range 1° to 90° relative to the horizontal, with the fold forming an obtuse angle relative to the flange extension.

The metal bars are fixed to one another by bolts, with the heads of the bolts being on the same side as the roadway. It is advantageous for the bolt locations to be compatible with those in bars already in service, thereby facilitating fitting the two different kinds of bar together. However, it is neverthe-less necessary to place two bolts in the bar overlap zone in order to ensure that the assembly is sufficiently secure.

By virtue of the section having a large moment of inertia about a vertical axis, it is possible to select the thickness of the section over the range 1.5 mm to 3 mm, with a preferred thickness being 2 mm, which provides an advantageous compromise between high strength for withstanding shock and low unit weight for a length of bar, which is then about 60 kg.

This large moment of inertia (about twice that of bars currently in service) makes it possible to space the supports at intervals of about 6 m, while retaining the same effectiveness against shock as is provided by the barriers presently in service with supports at 4 m intervals. The radius of the curve over which an out-of-control vehicle is guided is then increased.

It may also be observed that the large development of the rib margin makes it possible to hide the tops of the supports used from car drivers, and also gives them a feeling of greater security given the visible thickness of the bar, assuming the driver is in a normal driving position.

In order to provide a greater understanding of the subject matter of the invention, there follows a description by way of purely illustrative and non-limiting example of several embodiments which are shown in the accompanying drawings.

Figure 2:
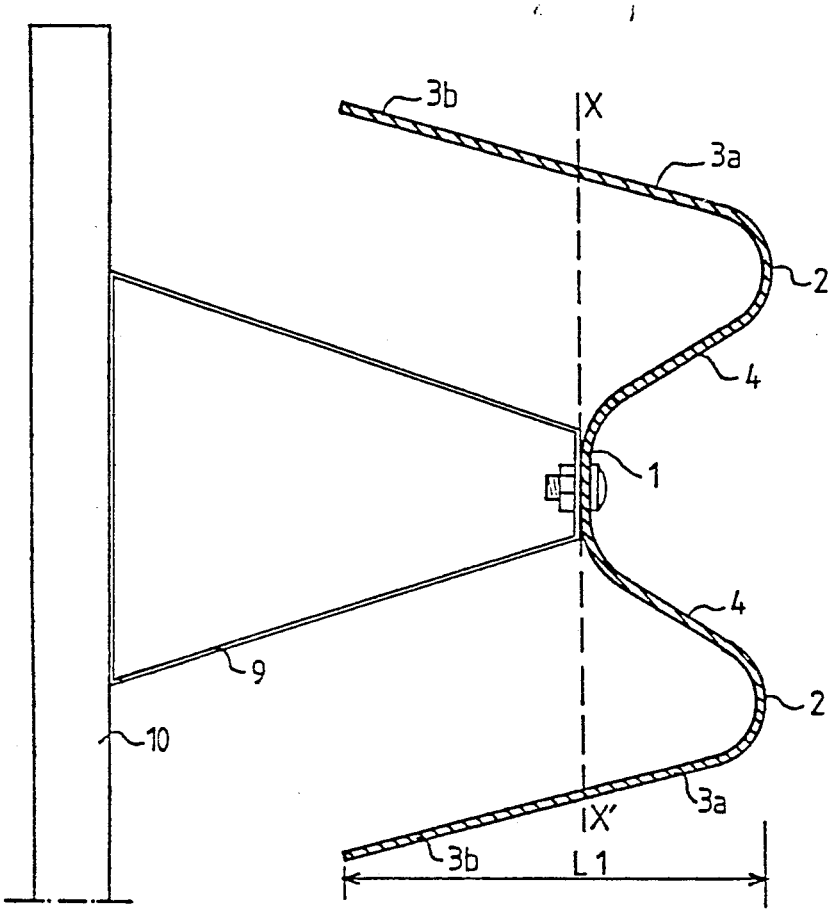
FIG. 2 is a section on II—II of FIG. 1.
Figure 3:
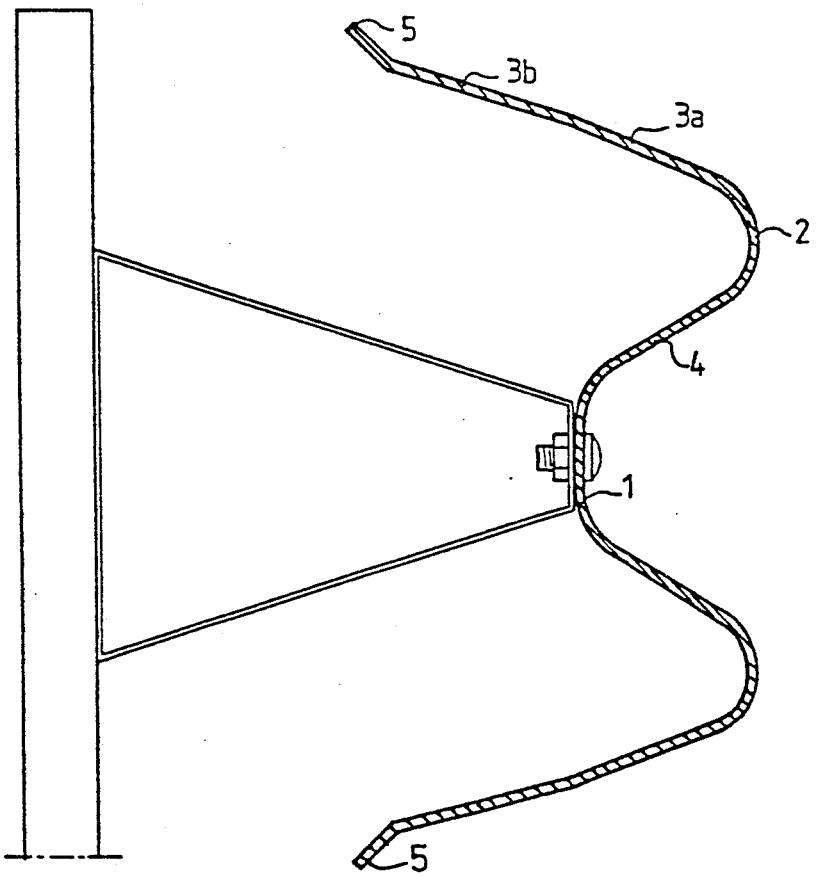

FIG. 3 is a section through a variant of FIG. 2, which variant has two substantially parabolic ribs developed over the portions 4, 2, 3*a*, and 3*b* of the section. The vertex of the parabola is situated on portion 2 of the rib.

In addition, FIG. 3 shows a stiffening fold at about 45° to the horizontal.

Figure 4:
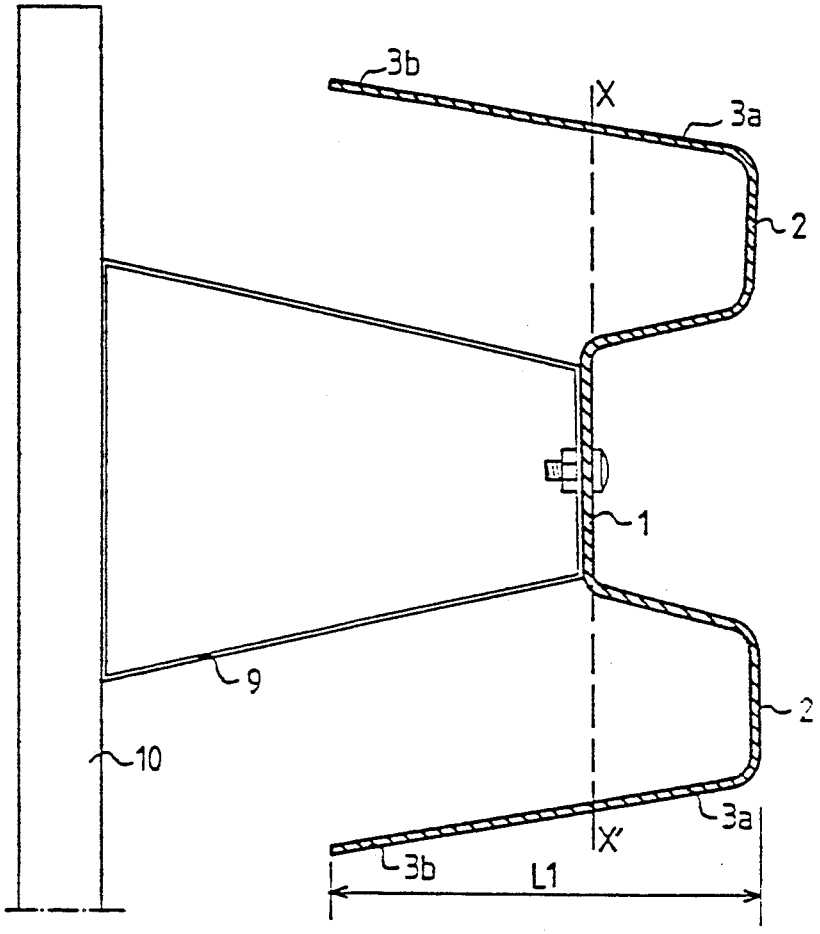

FIG. 4 shows a possible variant of FIG. 2 reproducing all of the characteristic portions of the bar, but the ribs are less rounded and correspond to currently used B-type barriers.

Figure 5:
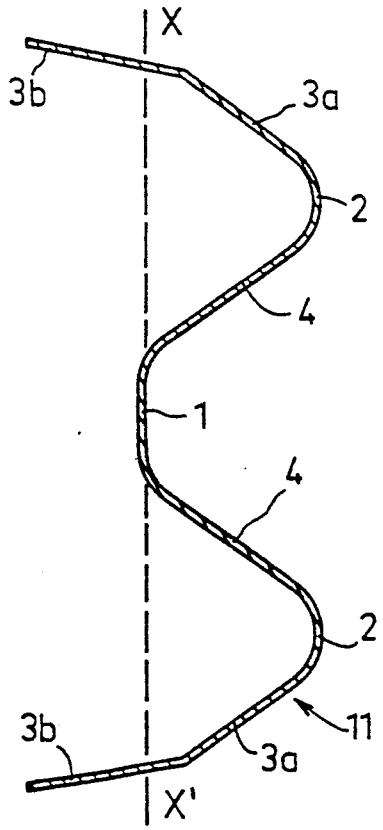

FIG. 5 shows the preferred embodiment of the invention obtained on the basis of a currently used A-type bar.

The width of the outer margins may lie in the range 8 cm to 20 cm, depending on the selected target for resistance to shock.

Figure 1:
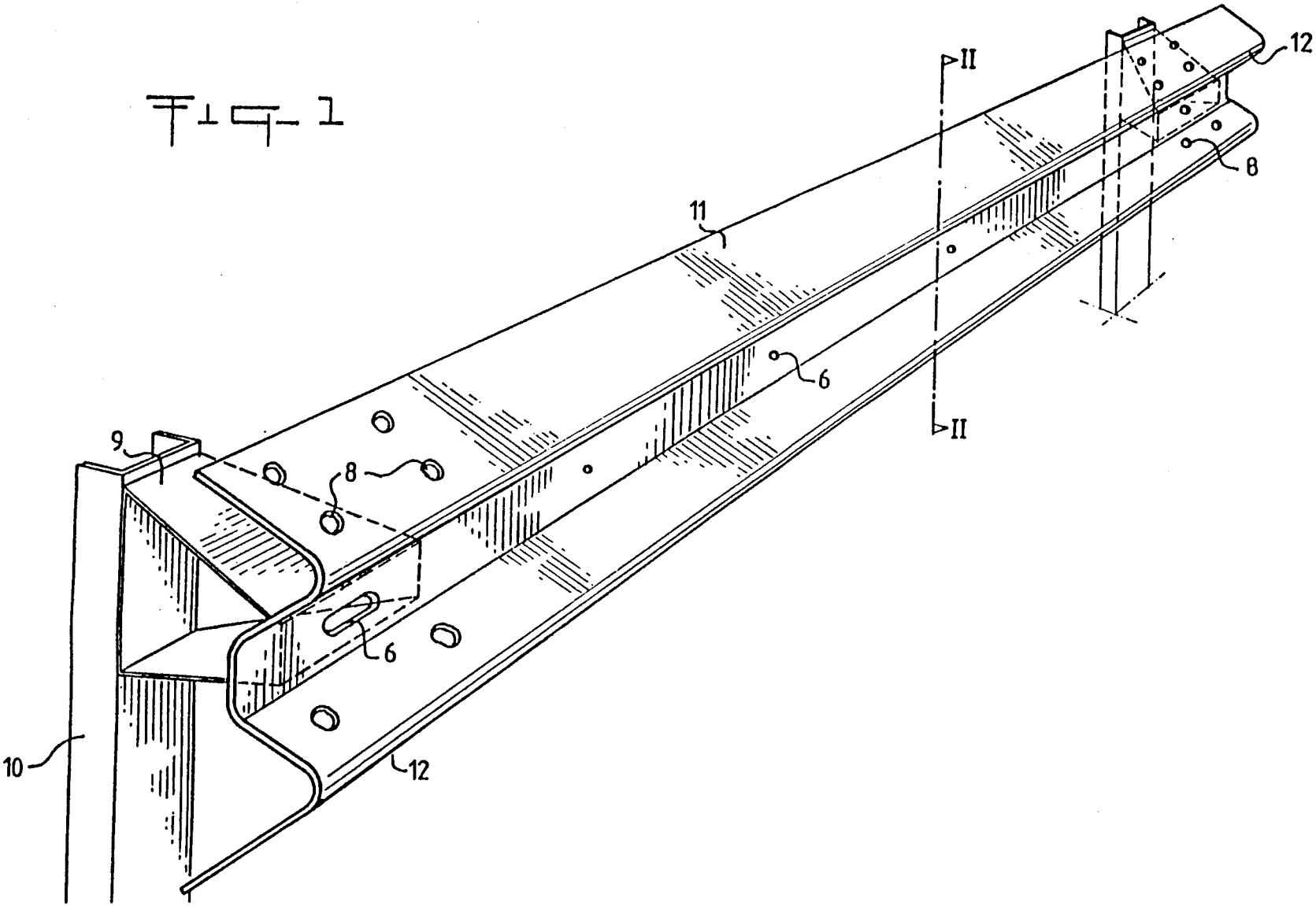
FIG. 1 is a perspective diagram of a barrier of the invention, shown bolted to a support with a spacer 9 maintaining a distance of about 20 cm between the central groove of the barrier and the support.

With reference to the drawings, and more particularly to FIGS. 1 and 2, it can be seen that 11 designates the metal bar of a safety barrier. Bars 11 are connected together by overlapping in end zones 12 where additional bolt holes 8 can be seen. The bar is supported by vertical posts 10. The bar 11 has a W-shaped section and its central groove is referenced 1, with the ribs on either side of the central groove 1 being designated 2.

The outer flange 3*a* of, each of the ribs 2 extends about 7 cm beyond a vertical plane XX' which is substantially tangential to the bottom of the groove 1 by means of respective flange extensions 3*b*.

The total width of the bar (L1) is about 15 cm, but the width of the flange extensions may be selected to lie in the range about 3 cm to about 12 cm depending on the stiffness desired for the intended application.

Finally, bar stiffness may also be increased by making a fold 5 having a width of 2 cm to 5 cm at the end of the flange extension 3*b* (FIG. 3). This fold may either lie substantially on an extension of the margin (at least 1° relative to a horizontal plane), or else on the contrary it may be raised up to 90°.

The general shape of the bar as seen in right cross-section could also be constituted by two substantially parabolic segments on either side of the central groove: each parabolic segment then extends continuously over portions 4, 2, 3*a*, and 3*b*. The vertex of the parabola is then the point on the rib 2 which is closest to the roadway. Given this shape, a shock on the ribs 2 is transmitted under the best possible conditions to the flange 3*a*, 3*b* and to the portion 4 which bears against the groove 1.

These two substantially parabolic segments are connected to the flat at the bottom of the groove 1 via a curved section extending tangentially to the flange 4 and to the groove 1.

When the bar is designed to have a moment of inertia which is considerably greater than that of presently existing bars (about twice), barriers may be supported at intervals of as much as 6 m, such that bars may be manufactured which are 6 m long plus the required inter-bar overlap lengths (giving a total length of about 6.31 m).

For a total developed width of the section of 61 cm (which corresponds to a conventional section plus two flange extensions of 7 cm each), selecting a thickness of 2 mm means that a bar which is 6.31 m long can be manufactured for a weight of about 60 kg (compared with 50 kg for a conventional bar which is 4 m long and 3 mm thick). This bar which is supported every 6 m requires one third fewer supports, spacers, and bolts to be installed than are required for a conventional bar. The weight of steel used per linear meter is also slightly less (about 10 kg compared with about 11.5 kg).

The great length of the bar makes it possible to vary choices when installing supports, depending on the desired maximum displacement in the event of a shock: the minimum spacing is one support every 6 m, followed by one support every 3 m. It may also be advantageous to install one support every 2 m, which means that a maximum of five slots 6 should be provided in the groove of the bar: two slots at respective ends 12, one in the middle, and two others dividing the bar into three, 2m-long lengths.

FIG. 5 shows a preferred embodiment of the invention. The bar 11 is obtained by extending the outer flange 3*a* of a standard A-type bar currently in use by means of a flange extension 3*b* which extends the outer flange 3*a* beyond the plane XX' that is tangential to the bottom of the central groove 1 through a distance lying between one-half and twice the depth of the central groove 1. The flange extensions 3*b* diverge as they extend rearwards from the bar 11. The flange extensions 3*b* are at an angle of about 11° to the horizontal, thereby enabling the bars 11 to be nested while being transported from the factory to the site where they are installed, and also enables the end 12 of each bar to overlie the end 12 of the adjacent bar during installation.

The depth of the central groove 1 and the ribs 2 on either side thereof is about 8 cm in the standard A-type bar commonly in use at present, its developed width is 47 cm, and its moment of inertia is 100 $cm^4$ for a thickness of 3 mm. Calculation shows that by extending the outer flanges 3*a* of the A-type profile by means of flange extensions 3*b* that are 6 cm long, a moment of inertia of 155 $cm^4$ is obtained using a bar that is 2 mm thick, and a moment of inertia of 232 $cm^4$ is obtained using a bar that is 2.5 mm thick. If the flange extensions 3*b* extend 8 cm, then the moment of inertia is 242 $cm^4$ for a bar that is 2 mm thick, and 363 $cm^4$ for a bar that is 2.5 mm thick. It can be seen that the moments of inertia are considerably increased for a greatly reduced weight of bar per linear meter when using a bar thickness of 2 mm, or for substantially the same weight per meter when using a bar of thickness 2.5 mm.

It is preferable for the lengths of the flange extensions 3*b* and the thickness of the bar 11 to be designed so that the moment of inertia of the bar 11 is increased by at least 50% compared with standard A or B type barriers.

Naturally the embodiments described above are not limiting and any desired modification may be made thereto without going beyond the scope of the invention.

I claim:

1. A deformable safety barrier placed along a roadside, the barrier being constituted by metal section bars (11) adapted to be assembled to one another by partial overlapping and by bolting, and adapted to be supported at intervals by vertical posts, the section bars (11) each having a central groove (1) with a rib (2) on either side thereof, the ribs having respective vertex lines lying in a common vertical plane which is parallel to a vertical plane (XX') that is tangential to the bottom of the groove (1), thereby forming a projection towards the road, each rib also having an outer flange (3*a*) extending away from the road and extended by a flange extension (3*b*) beyond the vertical plane (XX') which is tangential to the bottom of the central groove (1), the barrier being characterized in that the outer flanges (3*a*) of the ribs (2) of the section bars (11) extend beyond said vertical plane (XX') by a distance lying between one-half and twice the distance between said vertical plane (XX') and the plane passing through the vertex lines of the ribs (2), and being further characterized in that the lengths of the flange extensions (3*b*) of each of the section bars (11) and the thickness of each of the section bars (11) are such that the moment of inertia of the section bars is increased by at least 50% compared with standard A-type or B-type barrier section bars.

2. A safety barrier according to claim 1, characterized in that the flange extensions of the section bars include holes through which assembly bolts are adapted to be passed.

3. A safety barrier according to claim 1 or 2, in which each bar has a fixing hole at each end of its central groove enabling the bar to be fixed on a post, the barrier being characterized in that the bar further includes at least one additional fixing hole along its central groove, said fixing hole being regularly spaced apart along the central groove.

* * * * *